US006248288B1

(12) United States Patent
Kremer et al.

(10) Patent No.: US 6,248,288 B1
(45) Date of Patent: Jun. 19, 2001

(54) ROTATING MECHANISM WITH ARM

(75) Inventors: Victor Kremer, Luxembourg; Emile Lonardi, Bascharage, both of (LU); Philippe Malivoir, Thionville (FR)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/462,623

(22) PCT Filed: Jul. 4, 1998

(86) PCT No.: PCT/EP98/04129

§ 371 Date: Mar. 23, 2000

§ 102(e) Date: Mar. 23, 2000

(87) PCT Pub. No.: WO99/04044

PCT Pub. Date: Jan. 28, 1999

(30) Foreign Application Priority Data

Jul. 16, 1997 (LU) ..... 90093

(51) Int. Cl.[7] ..... C21C 5/48
(52) U.S. Cl. ..... 266/273; 266/271
(58) Field of Search ..... 266/45, 271, 272, 266/273

(56) References Cited

U.S. PATENT DOCUMENTS

| | | | | |
|---|---|---|---|---|
| 3,765,663 | | 10/1973 | Legille et al. | 266/45 |
| 4,220,321 | * | 9/1980 | Brucher | 266/271 |
| 4,247,088 | | 1/1981 | Ueno et al. | 266/273 |
| 5,246,208 | * | 9/1993 | Mailliet et al. | 266/273 |

* cited by examiner

*Primary Examiner*—Scott Kastler
(74) *Attorney, Agent, or Firm*—Nath & Associates PLLC; Gary M. Nath; Marvin C. Berkowitz

(57) ABSTRACT

A device for rotating a work element is disclosed. The device has a support structure, an arm mounted in the support structure in such a way that it can rotate, a rotation drive for rotating the arm around a rotation pin, the rotation drive being located between the arm and the support structure, and a lifting drive. The support structure represents the frame and the arm represents a driven member of a gear. The lifting drive closes the gear between the support structure and the arm. A coupling device is connected in series with the lifting drive in such a way that the lifting drive can be uncoupled from the gear. The coupling device may have a rotating arm and a locking device, for example. The device can be used as a compact rotating device for carrying a blast furnace gun.

23 Claims, 5 Drawing Sheets

ROTATING MECHANISM WITH ARM

FIELD OF THE INVENTION

The invention relates to a swivelling device with jib for swivelling a working unit between a rest position and an operating position. A device of this type is used, for example, to swivel a taphole gun mounted on the jib into an operating position in front of the taphole of a blast furnace and for subsequent pressing of the gun against the taphole.

BACKGROUND OF THE INVENTION

A conventional swivelling device for a taphole gun comprises in an already known way a jib, the taphole gun being mounted on its free end. The other end of the jib is pivoted in a fixed supporting structure. The swivelling range of the jib should be as large as possible to enable the gun to swivel as far as possible from the runner. Furthermore, it should be stated that modern taphole guns operate with increasingly higher plugging pressures. Consequently the swivelling device, which is to press the plugging gun against the taphole, must also be designed for increasingly higher contact forces.

Hydraulic cylinders are currently used in the taphole plugging machines to swivel the jib. When work was still carried out with lower plugging pressures on the blast furnace, rotary motors were also used as the jib drive instead of the hydraulic cylinders. A taphole plugging machine with an electric motor is described, for example, in DE-A-895604. This electric motor transmits its force moment via a toothed-wheel and worm mechanism to the jib. A magnetic brake permits locking of the jib in the operating position. It is obvious that in the case of modern plugging machines with extremely high contact pressures such a solution is no longer economically viable.

A taphole gun with a hydraulic cylinder and hydraulic rotary motor is already known from U.S. Pat. No. 3,765,663. An arm securely connected to the jib, on which the piston rod of a double-acting hydraulic cylinder is secured by a first swivel joint, extends radially to the swivelling axis of the jib. The casing of this hydraulic cylinder is secured by a second swivel joint to a fixed arm, which projects a long way beyond the supporting structure of the jib. The hydraulic rotary motor is secured in the jib. It engages via a pinion with a gear wheel securely mounted on the supporting structure of the jib. This rotary motor swivels the jib between a rest and an operating position. The task of the hydraulic cylinder is merely to transmit a force moment to the jib in the operating position in order to press the gun against the taphole and subsequently pull it off again. The hydraulic cylinder is switched on only in a short swivelling range near the furnace. Its two pressure chambers are discharged to the tank over the remaining swivelling range. The stroke of the hydraulic cylinder is designed in such a way that during swivelling of the jib the length of the hydraulic cylinder is automatically adapted to the variable distance between the first and second swivel joints. In other words the swivelling device is a closed three-element mechanism, whereby the supporting structure forms the frame, the supporting arm the driven element, and the hydraulic cylinder, as an element with a variable length, closes the mechanism between the supporting structure and the jib.

A swivelling device for a taphole gun, which is intended to be characterised by its compactness, is already known from U.S. Pat. No. 4,247,088. It comprises a jib to carry the taphole gun, a supporting structure, in which the jib is pivoted at one end about a swivelling axis, a rotary drive to swivel the jib between its rest position and operating position and a hydraulic cylinder to generate a contact force. The hydraulic cylinder is supported by a lateral arm of the supporting structure. It is not securely connected to the jib, but can engage in a tooth system when the jib is swivelled into the operating position.

SUMMARY OF THE INVENTION

The present invention is based on the task of creating a more compact swivelling device.

Like the swivelling device from U.S. Pat. No. 4,247,088, a swivelling device according to the invention comprises a jib to carry the working unit; a supporting structure, in which the jib is pivoted at one end about a swivelling axis; a rotary drive to swivel the jib between its rest position and its operating position and a stroke generating drive to produce a contact force. In this configuration, as already mentioned, the supporting structure forms the frame, the supporting arm the driven element of a mechanism, which is closed by a stroke generating drive between the supporting structure and the jib. The swivelling device according to the invention likewise comprises a coupling device, which is connected in series to the stroke generating drive in such a way that the stroke generating drive can be disconnected from the positive movement of the mechanism. In other words an automatic change in length of the stroke generating drive during swivelling of the jib can be prevented by the coupling device. Consequently the total stroke of the stroke generating drive need be designed only for its actual function, i.e. the generation of a contact force in the operating position. By disconnecting the stroke generating drive during swivelling of the jib additional freedom of design with regard to arrangement of the stroke generating drive in the swivelling device is obtained. According to the invention this freedom of design is utilised in that the hydraulic cylinder is arranged along the jib, is supported by the latter and can bear on the supporting structure via the engaged coupling device to transmit a contact force. Consequently the swivelling device according to the invention is extremely compact. Furthermore, the power requirement of the swivelling device can be clearly reduced in many cases by disconnection of the stroke generating cylinder.

In a first advantageous embodiment the coupling device comprises a swivelling arm, which is pivoted in the supporting structure. The stroke generating drive is mounted between the swivelling arm and the jib. With the coupling device disconnected this swivelling arm can swivel freely in relation to the supporting structure and the jib, its swivelling axis being essentially coaxial with the swivelling axis of the jib. A locking device permits locking of the swivelling arm in the operating position in relation to the supporting structure, with the result that the stroke generating drive is engaged in the swivelling mechanism to transmit a contact force.

In a first embodiment a locking device for the swivelling arm described above has a bolt which can be inserted into and withdrawn from a suitable oblong hole for locking the swivelling arm in relation to the supporting structure. The locking bolt can be inserted in and withdrawn from the oblong hole e.g. by a short-stroke cylinder.

In a second embodiment a locking device for the swivelling arm described above has a swivelling locking bar, which in order to lock the swivelling arm can be swung into a position in which it rests against an abutment when the swivelling arm is in the operating position. The advantage of this locking device is that a shock-absorber, which dampens the coupling of the lifting drive to the swivelling mechanism, can be installed relatively easily in the abutment.

Swivelling devices according to the invention are advantageously suitable, for example, to carry a taphole gun, the latter being pivoted at the free end of the jib. In a first embodiment of this taphole plugging machine a rigid control rod is flexibly connected to the taphole gun and the supporting structure. This control rod thus determines the alignment of the taphole gun as a function of the swivelling angle of the jib in an already known way. If the swivelling device is equipped with the swivelling arm described above, however, the control rod can also be pivoted on this swivelling arm instead of on the supporting structure. In this case an active adjusting element, which allows the length of the control rod to be varied selectively, is mounted in the control rod so that the alignment of the taphole gun can be determined independently of the jib position.

In an alternative embodiment the coupling device comprises a first coupling head at the end of the piston rod of the hydraulic cylinder and a second coupling head on the supporting structure. The two coupling heads are complementary to each other. When the jib is in the operating position the first and second coupling heads are arranged in relation to each other in such a way that the first coupling head can be supported by the second coupling head by extending the piston rod of the hydraulic cylinder. If the jib is swivelled from its operating position towards its rest position, the first coupling head is separated from the second coupling head and the hydraulic cylinder can now be swivelled freely with the jib. The jib advantageously has a spring-centered aligning device for the hydraulic cylinder pivoted on the jib. This aligning device ensures that the hydraulic cylinder always comes to rest in a favorable coupling position when the jib is swivelled into its operating position.

BRIEF DESCRIPTION OF THE SEVERAL VIEWS OF THE DRAWINGS

Exemplified embodiments of the invention are described in more detail on the basis of the enclosed drawings.

DETAILED DESCRIPTION OF THE INVENTION

Figure 1:
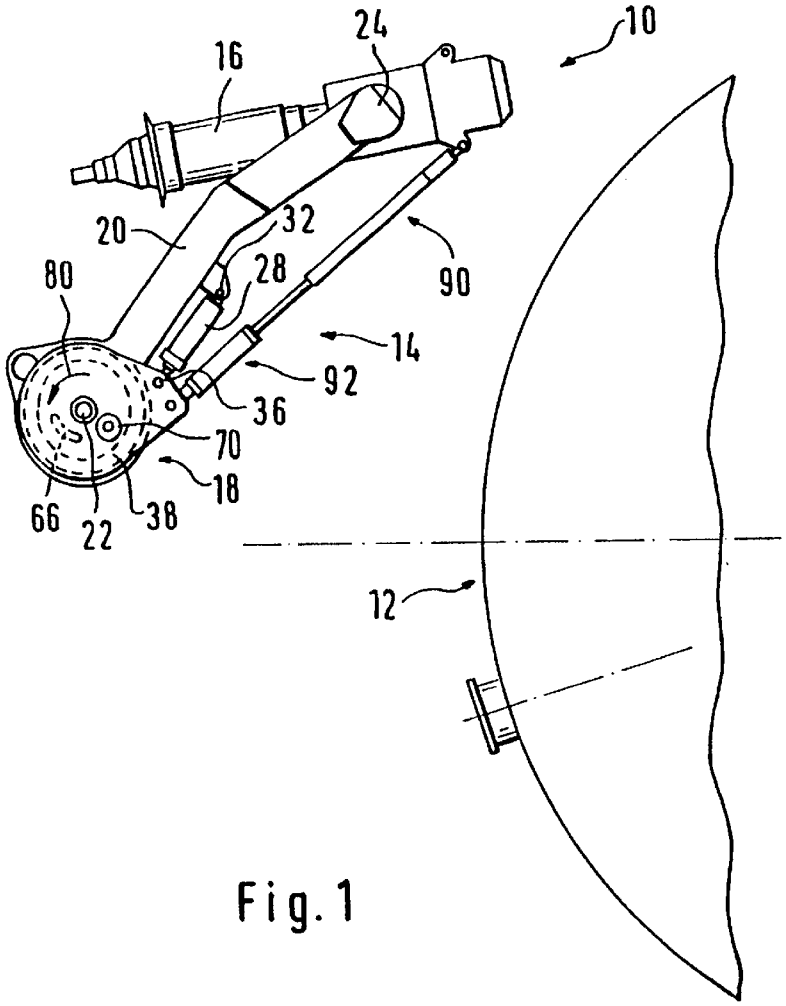
FIG. 1 shows a plan view of a taphole gun with a swivelling device according to the invention in the rest position in front of the blast furnace.

FIG. 1 shows a taphole plugging machine 10 according to the invention in a rest position in front of a blast furnace 12, which is indicated schematically by an arc of a circle. This taphole plugging machine 10 consists essentially of a swivelling device 14 according to the invention and an already known taphole gun 16. The latter will not be described in more detail.

The swivelling device 14 comprises a column-type base 18, which forms a supporting structure for a jib 20. Instead of being installed as a base on the floor, this supporting structure 18 can, of course, also be suspended. The jib 20 is pivoted at one end in this supporting structure 18. In FIG. 1 the position of the swivelling axis of jib 20 in the supporting structure 18 is indicated by the reference number 22. This axis 22 is generally inclined slightly towards the blast furnace in relation to the vertical. The taphole gun 16 is suspended at the free end of the jib 20. The position of the swivelling axis of the taphole gun 16 in the jib 20 is shown by the reference number 24.

A relatively short, preferably double-acting hydraulic cylinder 28 lies directly along the jib 20. One end of this hydraulic cylinder 28, i.e. the cylinder base in the embodiment shown, is connected by a first swivel joint 32 to the front end of the jib 20. For this purpose the jib 20 advantageously has a lateral projection, on which the first swivel joint 32 is mounted. The other end of the hydraulic cylinder 28, i.e. the piston rod end in the embodiment shown, is connected via a second swivel joint 36 to a swivelling arm 38. The latter is pivoted in the supporting structure 18, so that its swivelling axis is essentially coaxial with the swivelling axis of the jib 20.

Figure 3:
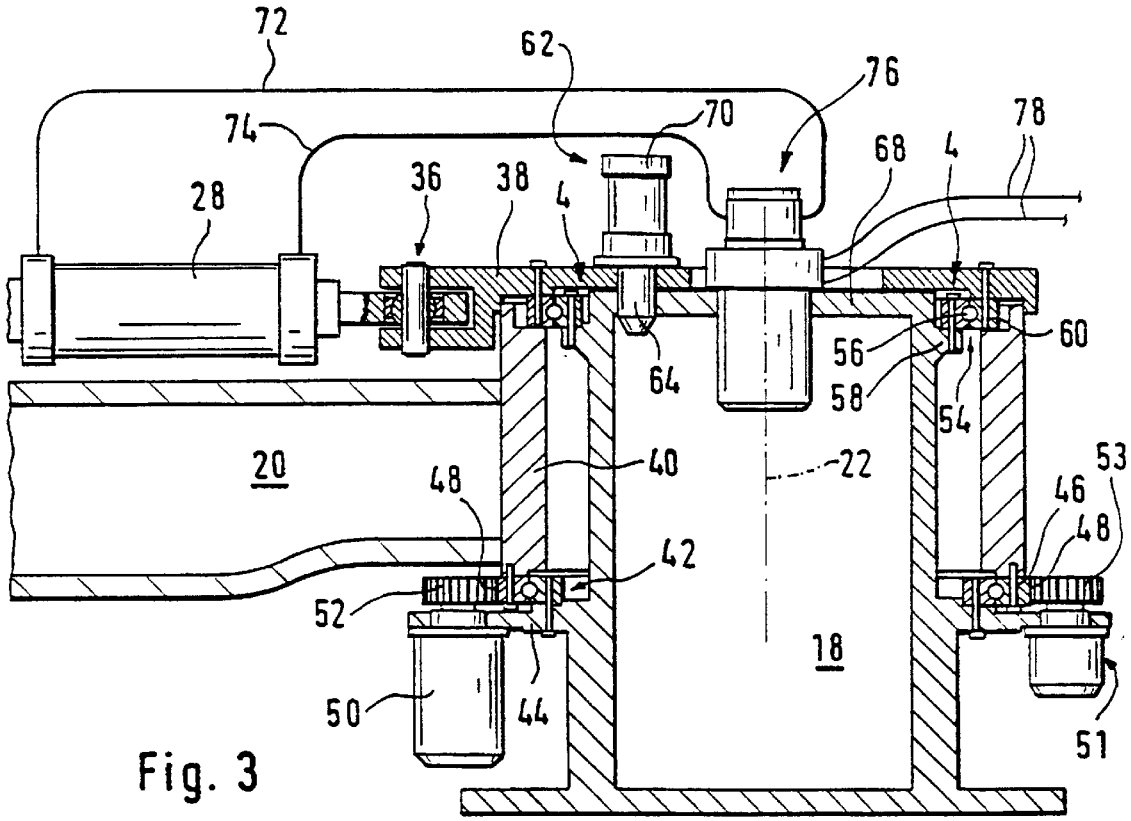
FIG. 3 a section along the section line 3—3 in FIG. 1.

The mounting of the jib 20 and swivelling arm 38 in the supporting structure is shown in more detail in FIG. 3. The jib 20 has at its supported end a cylindrical connection piece 40, which is secured by means of a ball bearing 42 to a flange 44 of the supporting structure 18. The outer raceway 46 of this ball bearing 42, i.e. the raceway on which the connection piece 40 is secured, forms a gear rim 48. A rotary motor, which may be designed, for example, as a hydraulic motor or electric motor, is designated 50. This rotary motor 50 is secured to the flange 44 and can engage in the gear rim 48 by means of a pinion 52. Consequently the rotary motor 50 can swivel the pivoted jib 20 about the axis 22. The exact angular position of the jib 20 is measured by an angle sensor 51 during swivelling. The latter is secured to the flange 44 like the rotary motor 50 and can engage in the gear rim 48 by means of a pinion 53.

The swivelling arm 38 is pivoted at the top end of the column-type supporting structure 18 by means of a ball bearing 54. As shown in FIG. 3, the inner raceway 56 of the ball bearing 54 is secured to a second flange 58 on the supporting structure 58 and the outer raceway 60 on the swivelling arm 38. The ball bearing 54 is coaxial with the ball bearing 42, so that the swivelling axis 22 of the jib 20 is identical with the swivelling axis of the swivelling arm 38.

Figure 4:
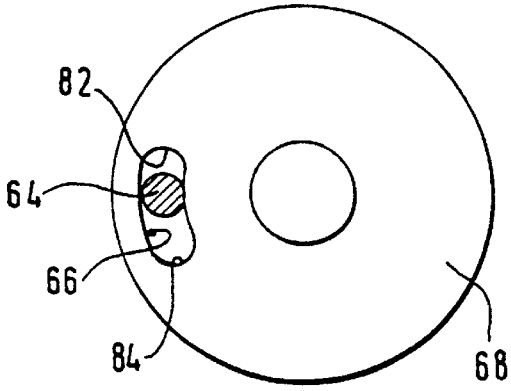
FIG. 4 a section along the section line 4—4 in FIG. 3.

A locking device is designated 62 in FIG. 3. This locking device 62 permits locking of the swivelling arm 38 on the supporting structure 18 to prevent rotation. For this purpose it comprises a locking bolt 64, which can be inserted in and withdrawn from an oblong hole 66 in a front cover plate 68 of the supporting structure 18 (see also FIG. 4). In a preferred embodiment the locking bolt 64 is formed by a piston of a short-stroke cylinder 70 secured on the swivelling arm 38.

Schematically represented flexible hydraulic connection lines of the hydraulic cylinder 28 are designated 72, 74 in FIG. 3. These hydraulic connection lines 72, 74 are advantageously incorporated in a hydraulic circuit 78 via a rotary connection 76. The lower part of the rotary connection is secured with prevention of rotation on the supporting structure 18, whereas the upper part, to which the lines 72, 74 are connected, is freely rotatable.

To summarise, it should be stated that the swivelling device 14 with the locked swivelling arm 38 is—from the kinematic point of view—really a closed three-element swivelling mechanism, whereby the supporting structure 18 forms the frame, the jib 20 the driven element and the hydraulic cylinder 28 as a sliding element closes the mechanism between the supporting structure and the jib. In this closed three-element swivelling mechanism the length of the sliding element, i.e. the hydraulic cylinder 28, would have to adapt to the position of the jib 20. In other words the stroke of the hydraulic cylinder 28 would have to vary continuously during swivelling of the jib 20 by the rotary motor 50. When the swivelling arm 38 is unlocked, however, the hydraulic cylinder 28 is disconnected from the swivelling mechanism, i.e. the swivelling device is—from the kinematic point of view—now an open mechanism with the rotary motor 50 as the sole drive or, in other words, a change in the position of the jib no longer causes a change in the stroke of the hydraulic cylinder 28. The swivelling arm 38 and locking device 62 thus form a coupling device, which is connected in series to the hydraulic cylinder 28 and with the aid of which the hydraulic cylinder 28 can be disconnected from the swivelling mechanism during swivelling of the jib 20 by the rotary motor 50.

Figure 2:
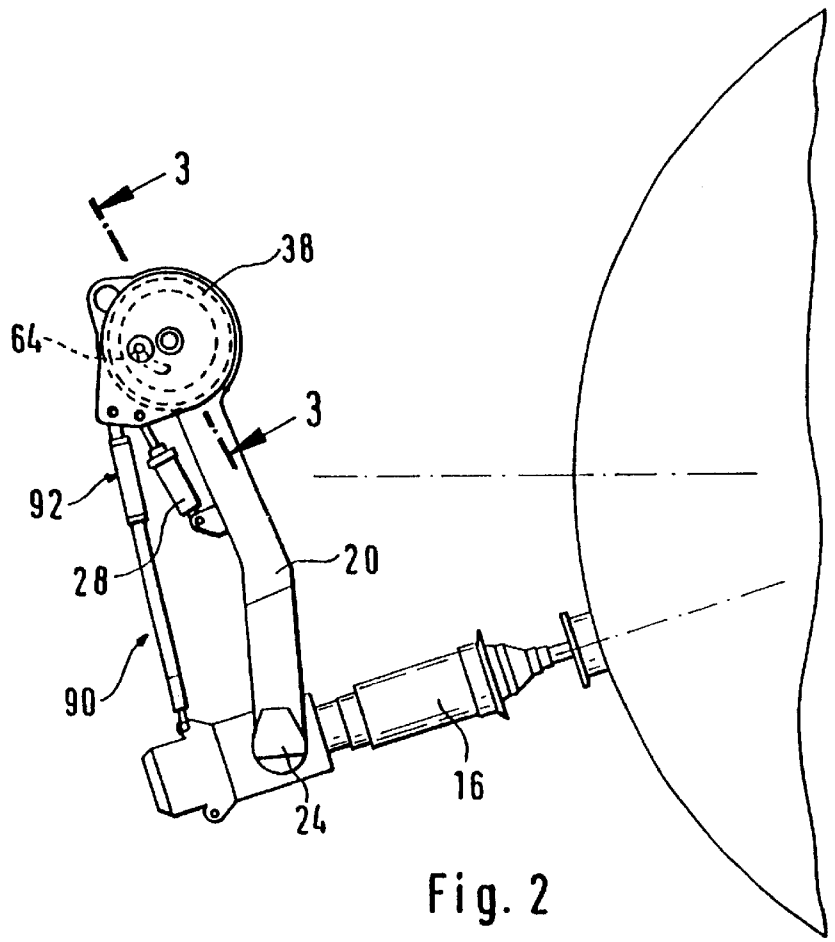
FIG. 2 a plan view of the taphole gun in FIG. 1 in the operating position in front of the blast furnace.

The method of operation of the swivelling device 14 described above will now be described in more detail with reference to FIGS. 1 and 2. In FIG. 1 the jib 20 with the taphole gun 16 is in a rest position. The piston rod of the hydraulic cylinder 28 is fully retracted. The locking device 62 is unlocked, i.e. the hydraulic cylinder 28 is disconnected from the swivelling mechanism. If the rotary motor 50 is actuated, the jib 20 is swivelled from the rest position in FIG. 1 into the operating position in FIG. 2. The freely rotatable swivelling arm 38, which is connected via the hydraulic cylinder 28 to the jib 20, is swivelled with the jib 20 in the direction of the arrow 80. During swivelling of the jib into its operating position the locking bolt 64 lies above the oblong hole 66 in the supporting structure 18 at a specific angular position of the jib 20. In this position the short-stroke cylinder 70 can be actuated, whereby the locking bolt 64, which had until now been retracted, enters the oblong hole 66 of the supporting structure 18 and assumes the position shown in FIG. 3. The extension of the locking bolt 64 is advantageously tripped via the angle sensor 51 as a function of the angular position of the jib 20. As soon as the locking bolt 64 is inserted into the oblong hole 66, the piston rod of the hydraulic cylinder 28 can be extended. Consequently the swivelling arm 38 is swivelled in the opposite direction of the arrow 80 until the locking bolt 64 rests against a first closure 82 of the oblong hole 66 in the supporting structure 18. When the locking bolt 64 is in this position, the hydraulic cylinder 28 is incorporated in the swivelling mechanism for transmission of a pressing force to the jib 20. In other words the hydraulic cylinder 28 bears via the swivelling arm 38 and the locking bolt 64 on the supporting structure 18 in order to exert a force moment on the jib 20, with the result that the taphole gun is pressed against the taphole. For subsequent pulling of the gun from the taphole the piston rod of the hydraulic cylinder 28 is retracted. In this case the locking bolt 64 first moves in the oblong hole 66 until it rests on a second closure 84 of the oblong hole 66 in the supporting structure 18. When the locking bolt 64 is in this position, the hydraulic cylinder 28 is incorporated in the swivelling mechanism for transmission of a force moment acting in the opposite direction to the jib 20. In other words it bears via the swivelling arm 38 and the locking bolt 64 on the supporting structure 18 in order to swivel the jib 20 away from the blast furnace 12. While the hydraulic cylinder 28 is actuated for pressing on or pulling away the taphole gun 16, the rotary motor 50 advantageously idles. During subsequent swivelling of the jib from its operating position the locking bolt 64 is withdrawn from the oblong hole 66 at a specific angular position of the swivelling arm 38. The rotary motor 50 can now swivel the jib 20 back into the rest position shown in FIG. 1 without the need for the hydraulic cylinder 28 to change its length.

The taphole gun 16 is advantageously aligned at the taphole via a control rod. A conventional control rod, which is pivoted at one end on a fixed point of the supporting structure 18 and at the other end on the taphole gun 16 (see, for example, FIGS. 7 and 8), could be used in this case. However, a new control rod arrangement is shown in FIGS. 1 and 2. It is a control rod 90 of variable length, which is pivoted at one end on the swivelling arm 38 and at the other end on the taphole gun 16. The length of the control rod 90 is varied via a built-in stroke generating drive, for example a hydraulic cylinder 92 or a spindle drive. During swivelling of the jib 20 from the rest position into the operating position the length of the control rod 90 is changed synchronously by admission of pressure to the hydraulic cylinder 92. The control rod 90 rests on the swivelling arm 38 locked by the hydraulic cylinder 28 in order to swivel the taphole gun 16 about the swivelling axis 24. This control rod arrangement has important advantages. Firstly, it should be noted that the control rod 90 is always on the same side of the jib 20. In other words the control rod 96 must not cross the jib 20 during swivelling. Consequently the overall height of the machine is reduced. Secondly, it should be noted that alignment of the taphole gun during swivelling can be designed substantially more flexibly than with a conventional control rod. A comparison of FIGS. 1 and 7, for example, reveals that the machine in FIG. 1 has a substantially more compact position than the machine in FIG. 7. It should also be emphasized that in this embodiment the jib 20 can perform a complete revolution about its swivelling axis 22.

Figure 5:
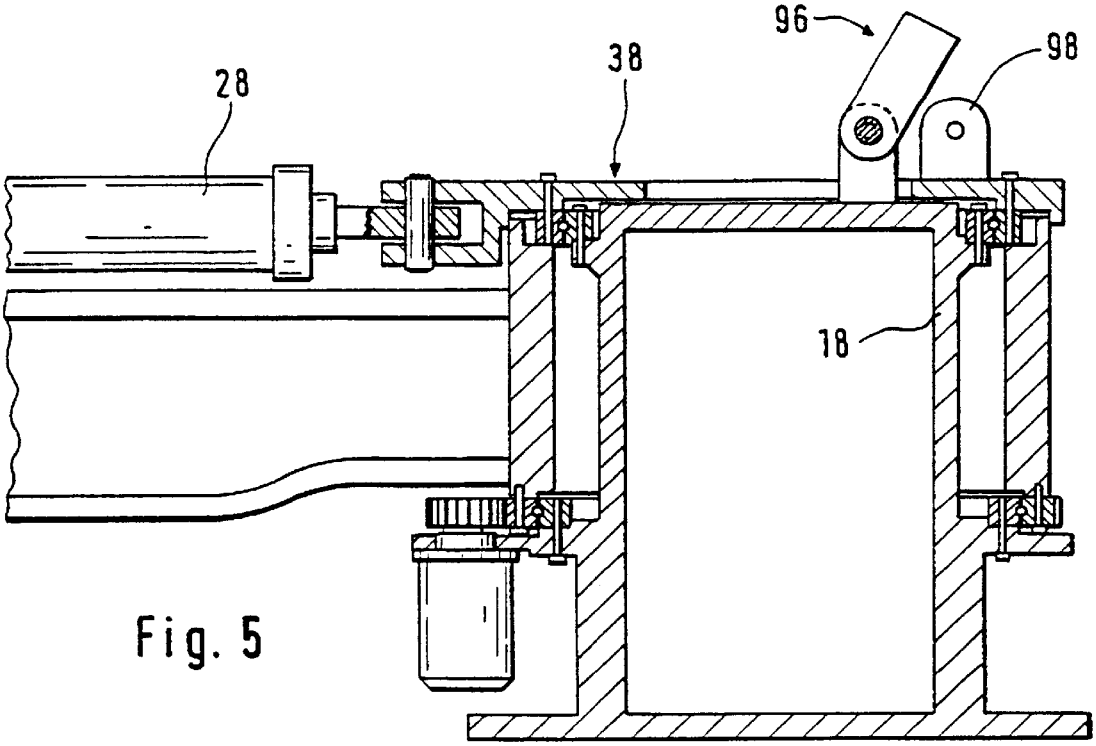
FIG. 5 a section as shown in FIG. 3 with an alternative locking device, the latter being shown in the unlocked position.
Figure 6:
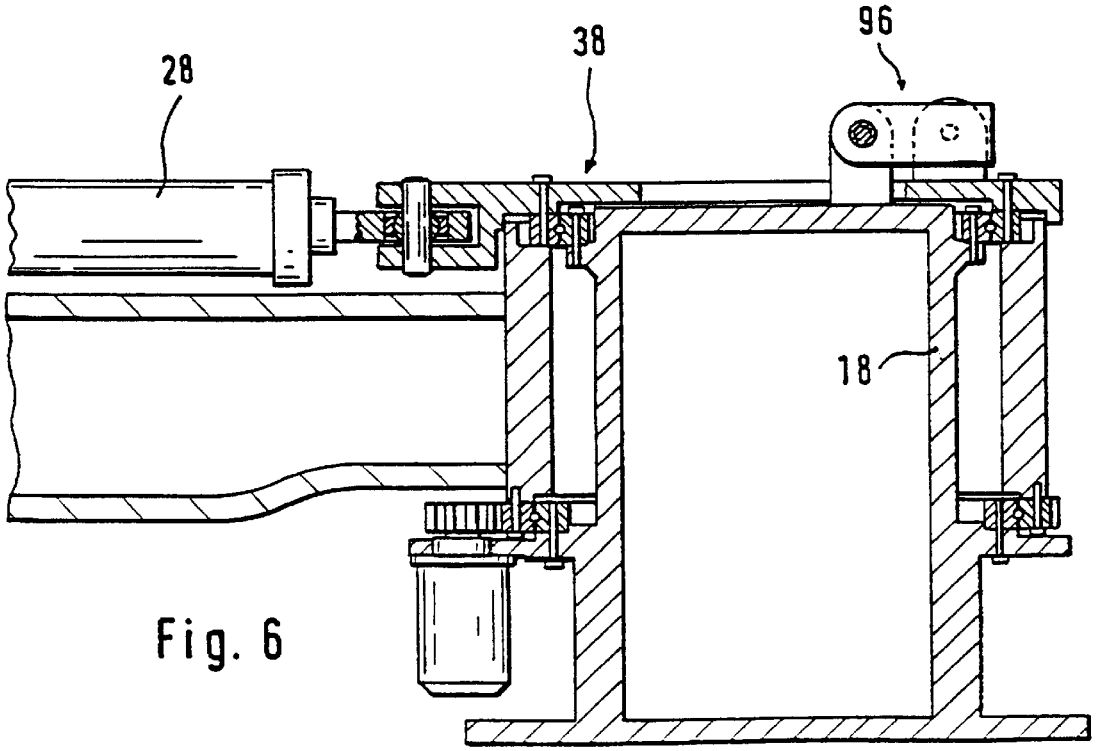
FIG. 6 the same section as in FIG. 5, the swivelling device being shown in the locked position.

An alternative embodiment of the locking device of the swivelling arm 38 will be briefly explained with reference to FIGS. 5 and 6. This locking device comprises a swivelling locking bar 96 on the supporting structure 18 and at least one abutment 98 on the swivelling arm 38. In FIG. 5 the swivelling locking bar 96 is shown in the unlocked position of the locking device. In FIG. 5 the swivelling locking bar 96 is shown resting against the abutment 98. A shock-absorber, which dampens the engagement of the hydraulic cylinder 28 in the swivelling mechanism, can be integrated very easily in the abutment 98. It should be noted that the swivelling device advantageously has two abutments arranged at an angle to each other, the swivelling locking bar resting against the first abutment when the taphole gun 16 is pressed against the taphole and against the second abutment when the taphole gun 16 is pulled away from the taphole.

Figure 8:
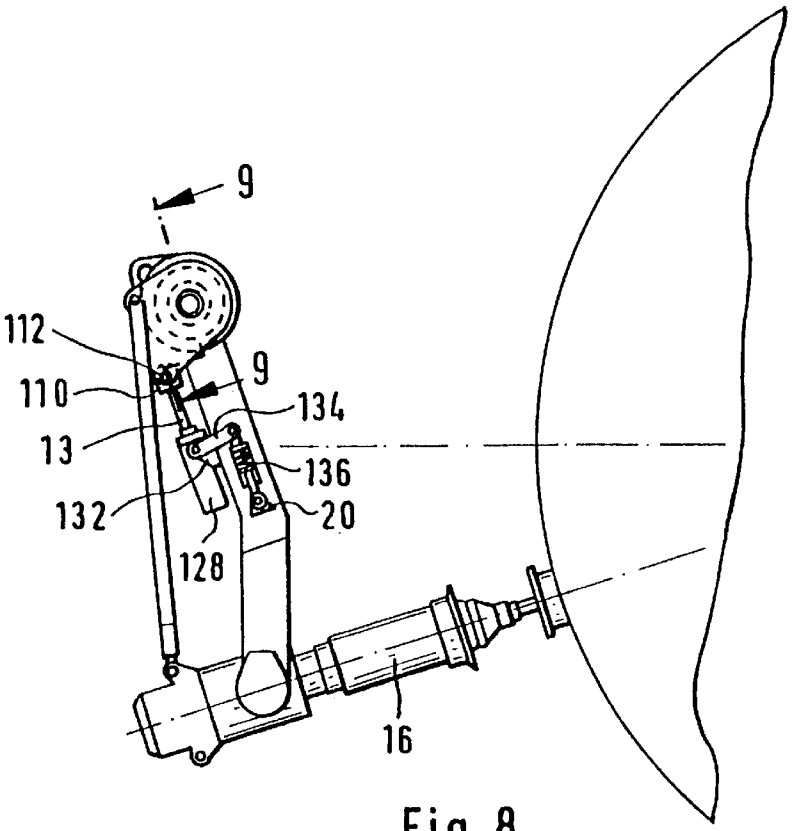
FIG. 8 a plan view as in FIG. 2 with the swivelling device according to FIG. 7.
Figure 7:
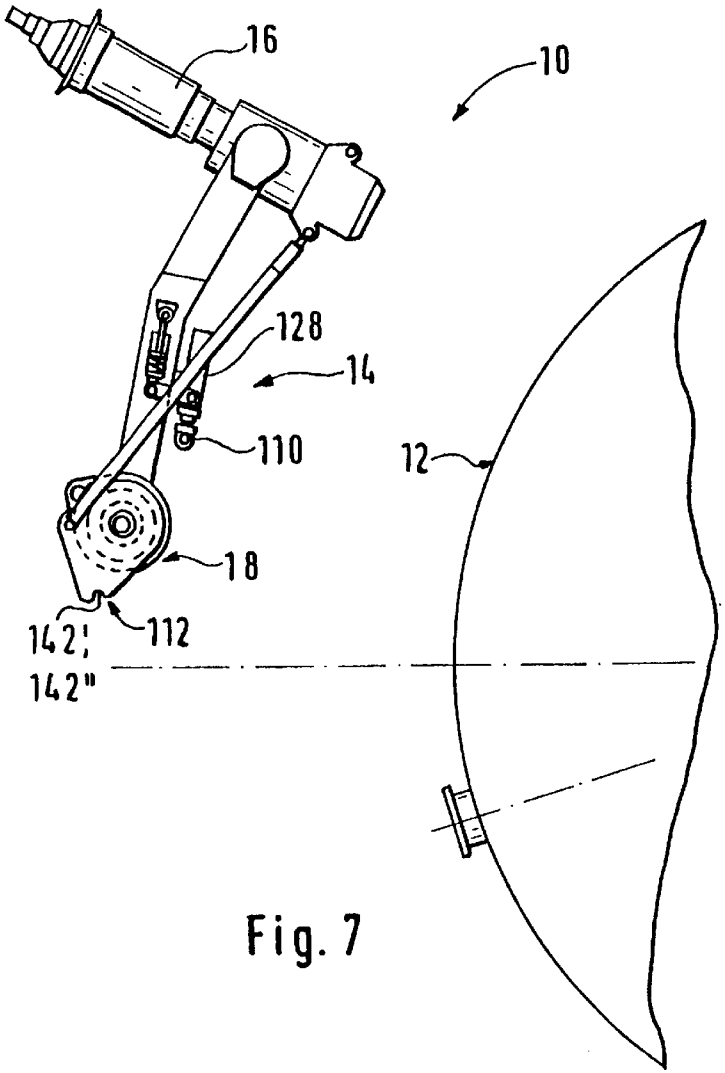
FIG. 7 a plan view as in FIG. 1 with an alternative design of the swivelling device.

An alternative embodiment of the entire coupling device of the hydraulic cylinder 28 is described with the aid of FIGS. 7 and 8. This coupling device comprises a first coupling head 110 at the end of the piston rod 130 of the hydraulic cylinder 128 as well as a second coupling head 112 on the supporting structure 18. The second coupling head 112, which is complementary to the first coupling head 110, is designed as a fixed point on the supporting structure 18.

When the mounting is in the operating position (see FIG. 8) the first and second coupling heads 110, 122 are arranged in relation to each other in such a way that the first coupling head 110 can bear on the second coupling head 112 when the piston rod 130 of the hydraulic cylinder 128 is extended. In this position the hydraulic cylinder 128 is engaged in the swivelling mechanism for transmission of a contact force to the jib 20.

The hydraulic cylinder 128 is pivoted on a projection 132 of the jib 20. A lever 134 connects its swivelling axis to a spring-centered aligning device 136 on the jib 20. This aligning device 136 aligns the disconnected hydraulic cylinder 128 essentially parallel with the jib 20 and thus facilitates disconnection of the two coupling heads 110 and 112 when the jib 20 is in the operating position.

Figure 9:
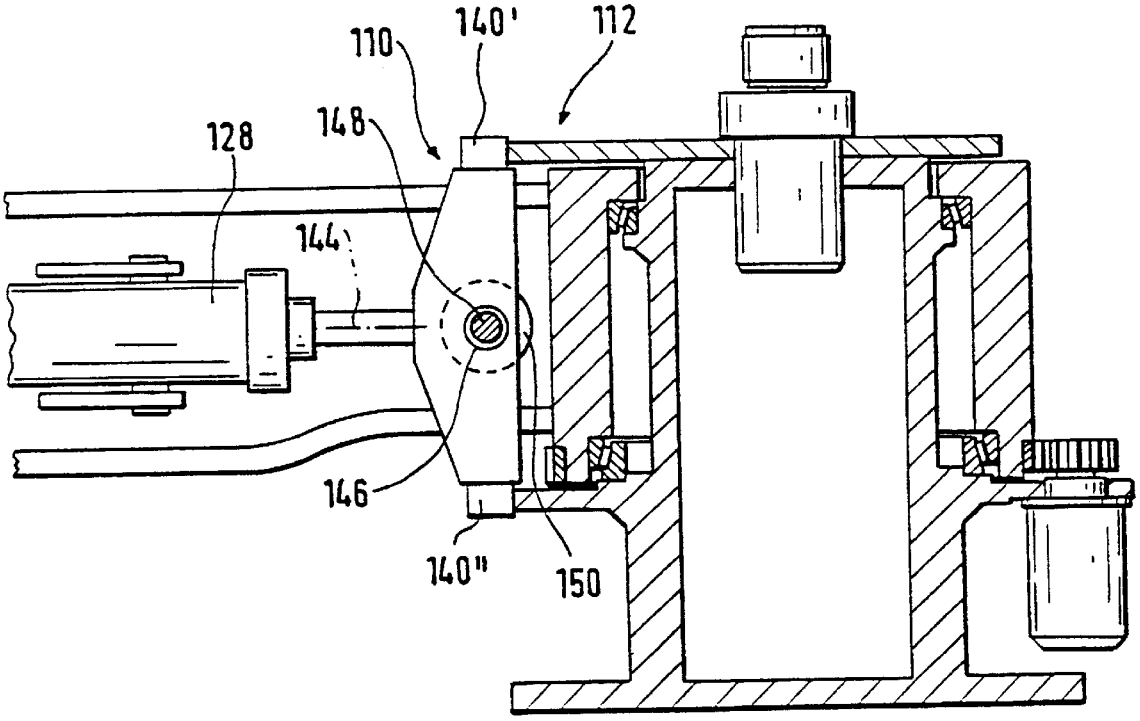
FIG. 9 a section along the broken section line 9—9 in FIG. 8.

In FIG. 9 the two coupling heads 110 and 112 are shown in the coupled position. It can be seen that the first coupling head 110 has two journals 140', 140", which are arranged symmetrically with the axis 144 of the hydraulic cylinder 128. In the coupled position these journals 140', 140" are mounted in corresponding bearing recesses 142', 142Δ (see FIG. 7) of the second coupling head 112. The reference number 146 indicates a hole in the first coupling head 110, through which a locking bolt 148 can be inserted. With the aid of this locking bolt 148 the first coupling head 110 can be mechanically locked in the supporting structure, so that the hydraulic cylinder 128 can also be used to pull the taphole gun 16 from the taphole. The locking bolt 148 can be actuated, for example, by a small hydraulic cylinder 150, which is secured to the supporting structure 18. Alternatively, however, the rotary motor 50 can also be designed for pulling the taphole gun 16 from the taphole. The force moment required for this purpose is in fact substantially smaller than the force moment required for pressing the taphole gun 16 against the taphole.

Finally, it should be noted that the swivelling devices described are particularly advantageous if a large swivelling angle and a high contact force are required. Further advantages are their compactness and low oil consumption. For this purpose it should be noted that a low oil consumption not only has a favorable effect on the design of the hydraulic system, but in most cases likewise has a positive effect on the energy consumption of the swivelling device.

What is claimed is:

1. A device for swivelling a working unit between a rest position and an operating position, comprising:

a jib to carry the working unit;

a supporting structure, in which the jib is pivoted about a swivelling axis at one end;

a rotary drive between the jib and the supporting structure for swivelling the jib between its rest position and its operating position; and a hydraulic cylinder between the jib and the supporting structure to generate a contact force;

the supporting structure representing a frame and the jib the driven element of a mechanism and the hydraulic cylinder closing this mechanism between the supporting structure and the jib to transmit the contact force to the jib; and a coupling device, which is connected in series to the hydraulic cylinder in such a way that the hydraulic cylinder can be disconnected from the mechanism;

wherein the hydraulic cylinder is arranged along the jib, and is carried by the latter and can bear on the supporting structure via the engaged coupling device to transmit a contact force; and further comprising a swivelling arm, which is pivoted in the supporting structure in such a way that the swivelling arm is pivoted in relation to the supporting structure and the jib about a swivelling axis, which is essentially coaxial with the swivelling axis of the jib, the hydraulic cylinder being connected to the swivelling arm; and a locking device for locking the swivelling arm in relation to the supporting structure;

wherein the locking device has a bolt, which can be inserted in the withdrawn from a corresponding hole to lock the swivelling arm in relation to the supporting structure.

2. The device according to claim 1, wherein the locking device has a short-stroke cylinder for insertion and withdrawal of the bolt.

3. The device according to claim 1, wherein the locking device has a swivelling locking bar, which in order to lock the swivelling arm can be swivelled into a position in which it rests against an abutment when the swivelling arm is in the operating position.

4. The device according to claim 3, wherein the abutment comprises a shock-absorber.

5. A taphole plugging machine comprising a swivelling device according to claim 1; and further comprising:

a taphole gun which is pivoted at the free end of the jib; and a control rod which is flexibly connected to the taphole gun and the swivelling arm, the control rod having an actuating drive for adjustment of its length.

6. A device for swivelling a working unit between a rest position and an operating position, comprising:

a jib to carry the working unit;

a supporting structure, in which the jib is pivoted about a swivelling axis at one end;

a rotary drive between the jib and the supporting structure for swivelling the jib between its rest position and its operating position; and a hydraulic cylinder between the jib and the supporting structure to generate a contact force;

the supporting structure representing a frame and the jib the driven element of a mechanism and the hydraulic cylinder closing this mechanism between the supporting structure and the jib to transmit the contact force to the lib; and a coupling device, which is connected in series to the hydraulic cylinder in such a way that the hydraulic cylinder can be disconnected from the mechanism;

wherein the hydraulic cylinder is arranged along the jib, and is carried by the latter and can bear on the supporting structure via the engaged coupling device to transmit a contact force; and further comprising:

a first coupling head at the end of a piston rod of the hydraulic cylinder;

a second coupling head on the supporting structure complementary with the first coupling head; p2 wherein the first and second coupling heads are arranged in relation to each other in such a way that when the jib is in the operating position the first coupling head can bear on the second coupling head by telescopic extension of the piston rod of the hydraulic cylinder.

7. The device according to claim 6, further comprising a spring-centered aligning device for the hydraulic cylinder pivoted on the jib.

8. The device according to claim 6, further comprising a locking device, which is assigned to the two coupling heads in such a way that the first coupling head can be locked mechanically in the second coupling head.

9. A device for swivelling a working unit between a rest position and an operating position, said device comprising:

a jib having a first end and a second end, said working unit being connect to said first end;

a supporting structure in which said second end of said jib is pivotably supported so as to define a swivelling axis for said jib;

a rotary drive connected between said jib and said supporting structure for swivelling said jib about said swivelling axis between said rest position and said operating position;

a hydraulic cylinder that is arranged laterally along said jib; and a coupling device that is capable of:

closing a force transmitting mechanism formed by said supporting structure, said jib and said hydraulic cylinder when said jib is in said operating position, so that a stroke of said hydraulic cylinder in said closed mechanism results in the transmission of a moment of force onto said jib; and opening said force transmitting mechanism when said jib is swivelled by said rotary drive between said rest position and said operating position, so that said hydraulic cylinder is carried by said jib, remains substantially parallel to said jib and is not subjected to length variations.

10. The device according to claim 9, wherein:

said coupling device includes a swivelling arm that is supported by said supporting structure so as to be capable of swivelling relative to said supporting structure and to said jib about a swivelling axis that is essentially coaxial with said swivelling axis of said jib, and a locking device for locking said swivelling arm in rotation relative to said support structure; and said cylinder is connected between said swivelling arm and said jib.

11. The device according to claim 10, wherein said locking device includes a locking bolt and a short-stroke cylinder for actuating said locking bolt and blocking said swivelling arm in said supporting structure.

12. The device according to claim 11, wherein said short-stroke cylinder is supported by said swivelling arm and said locking bolt is capable of engaging an oblong hole in said supporting structure, said oblong hole defining two spaced end stops for said locking bolt.

13. The device according to claim 10, wherein said locking device includes a swivelling locking bar co-operating and at least one abutment.

14. The device according to claim 13, wherein said abutment comprises a shock-absorber.

15. The device according to claim 9, wherein:

said hydraulic cylinder includes a piston rod;

said coupling device includes a first coupling head supported by said piston rod and a second, complementary coupling head supported by said supporting structure;

said first and second coupling head being disengaged when said jib is swivelled by said rotary drive between said rest position and said operating position; and said first and second coupling head being capable of engaging each other when said jib is in its operating position, so that said hydraulic cylinder can bear with its piston rod on said support structure to transmit a moment of force onto said jib.

16. The device according to claim 15, wherein:

said jib has a lateral projection;

said hydraulic cylinded is pivotably fixed to said lateral projection; and said device further comprises a spring-centered aligning device that is connect between said jib and said hydraulic cylinder so as to align the disconnected hydraulic cylinder essentially parallel with said jib.

17. The device according to claim 15, comprising a locking device that is associated with said two coupling heads in such a way that said first coupling head can be locked mechanically in said second coupling head.

18. A taphole plugging machine comprising:

a taphole gun; and a swivelling device for swivelling said taphole gun between a rest position and an operating position in front of a taphole; said swivelling device including:

a jib having a first end and a second end, said a taphole gun being pivotably connected to said first end of said jib;

a supporting structure in which said second end of said jib is pivotably supported so as to define a swivelling axis for said jib;

a rotary drive connected between said jib and said supporting structure for swivelling said jib about said swivelling axis between said rest position and said operating position;

a hydraulic cylinder that is arranged laterally along said jib; and a coupling device that is capable of:

closing a force transmitting mechanism formed by said supporting structure, said jib and said hydraulic cylinder when said jib is in said operating position, so that a stroke of said hydraulic cylinder in said closed mechanism results in the transmission of a moment of force onto said jib; and opening said force transmitting mechanism when said jib is swivelled by said rotary drive between said rest position and said operating position, so that said hydraulic cylinder is carried by said jib, remains substantially parallel to said jib and is not subjected to length variations.

19. The taphole plugging machine as claimed in claim 18, wherein:

said coupling device includes a swivelling arm that is supported by said supporting structure so as to be capable of swivelling relative to said supporting structure and to said jib about a swivelling axis that is essentially coaxial with said swivelling axis of said jib, and a locking device for locking said swivelling arm in rotation relative to said support structure; and said cylinder is connected between said swivelling arm and said jib.

20. The taphole plugging machine as claimed in claim 19 further comprising:

a control rod that is connected by means of articulations at one end to said taphole gun and at the other end to said swivelling arm; and an active adjusting element to vary the length of said control rod.

21. The taphole plugging machine as claimed in claim 18, wherein:

said hydraulic cylinder includes a piston rod;

said coupling device includes a first coupling head supported by said piston rod and a second, complementary coupling head supported by said supporting structure;

said first and second coupling head being disengaged when said jib is swivelled by said rotary drive between said rest position and said operating position; and said first and second coupling head being capable of engaging each other when said jib is in its operating position, so that said hydraulic cylinder can bear with its piston rod on said support structure to transmit a moment of force onto said jib.

22. The taphole plugging machine as claimed in claim 21, wherein:

said jib has a lateral projection;

said hydraulic cylinder is pivotably supported by said lateral projection; and said device further comprises a spring-centered aligning device that is connect between said jib and said hydraulic cylinder so as to align the disconnected hydraulic cylinder essentially parallel with said jib.

23. The taphole plugging machine as claimed in claim 21, comprising a locking device that is associated with said two coupling heads in such a way that said first coupling head can be locked mechanically in said second coupling head.

* * * * *

UNITED STATES PATENT AND TRADEMARK OFFICE

CERTIFICATE OF CORRECTION

PATENT NO. : 6,248,288 B1
DATED : June 19, 2001
INVENTOR(S) : Victor Kremer et al.

It is certified that error appears in the above-identified patent and that said Letters Patent is hereby corrected as shown below:

Column 8, claim 1,
Line 11, change "the" to -- and --,

Claim 6,
Line 15, change "lib" to -- jib --,
Line 26, delete "p2".

Signed and Sealed this

Twenty-sixth Day of February, 2002

*Attest:*

*Attesting Officer*

JAMES E. ROGAN
*Director of the United States Patent and Trademark Office*